United States Patent [19]

Goodman et al.

[11] 4,289,613

[45] Sep. 15, 1981

[54] LOW MOLECULAR WEIGHT HYDROLYZED POLYMERS OR COPOLYMERS AS DEPRESSANTS IN MINERAL ORE FLOTATION

[75] Inventors: Richard M. Goodman, Norwalk; Sim K. Lim, Stamford, both of Conn.

[73] Assignee: American Cyanamid Company, Stamford, Conn.

[21] Appl. No.: 95,812

[22] Filed: Nov. 19, 1979

[51] Int. Cl.[3] ..... B03D 1/06

[52] U.S. Cl. ..... 209/167

[58] Field of Search ..... 209/5, 166; 210/54, 210/166, 167

[56] References Cited

U.S. PATENT DOCUMENTS

| | | | |
|---|---|---|---|
| 2,740,522 | 4/1956 | Aimone | 209/166 |
| 3,310,710 | 3/1967 | Abernethy | 209/166 |
| 3,371,978 | 3/1968 | Iwasaki | 209/3 |
| 3,545,941 | 3/1969 | Wilson | 209/5 X |
| 3,572,504 | 3/1971 | De Cuyper | 209/166 |
| 3,805,951 | 4/1974 | Brogoitti | 209/5 |
| 3,929,629 | 12/1975 | Griffith | 209/167 |
| 3,975,496 | 8/1976 | Smalley | 209/5 X |
| 4,081,357 | 3/1978 | Werneke | 209/5 |
| 4,090,955 | 3/1978 | Dexter | 209/5 |

FOREIGN PATENT DOCUMENTS

| | | | |
|---|---|---|---|
| 1267631 | 5/1968 | Fed. Rep. of Germany | 209/166 |
| 130428 | 11/1960 | U.S.S.R. | 209/167 |
| 141826 | 11/1961 | U.S.S.R. | 209/167 |

*Primary Examiner*—Robert Halper

*Attorney, Agent, or Firm*—Paul W. Leuzzi, II

[57] ABSTRACT

Low molecular weight hydrolyzed polymers or copolymers of the general structure:

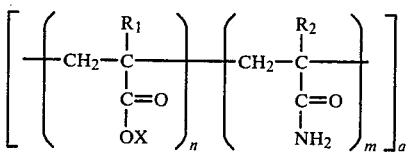

exhibit excellent depressive action in the flotation of non-sulfide mineral ores thereby resulting in improved selectivity and recovery. The low molecular weight, partially hydrolyzed polymers or copolymers perform depressing action without resulting in any associated flocculation in the flotation system. The partially hydrolyzed polymers or copolymers can be combined with other known depressing agents for non-sulfide ores, such as starch, dextrin, gum and the like, to obtain equivalent or improved selectivity and recovery than would be obtained using these depressants alone.

13 Claims, No Drawings

LOW MOLECULAR WEIGHT HYDROLYZED POLYMERS OR COPOLYMERS AS DEPRESSANTS IN MINERAL ORE FLOTATION

BACKGROUND OF THE INVENTION

In mineral ore flotation, depression comprises steps taken to prevent the flotation of a particular mineral. In one-mineral flotation systems, it is commonly practiced to hold down both the gangue materials and low-assay middlings. In differential flotation systems, it is used to hold back one or more of the materials normally flotable by a given collector.

Depression is conventionally accomplished through the use of reagents known as depressing agents or, more commonly, depressants. When added to the flotation systems, the depressing agents exert a specific action upon the material to be depressed thereby preventing that material from floating. The exact mode of this action remains open to speculation. Various theories have been put forth to explain this action; some of which include: that the depressants react chemically with the mineral surface to produce insoluble protective films of a wettable nature which fail to react with collectors; that the depressants, by various physical-chemical mechanisms, such as surface adsorption, mass-action effects, complex formation, or the like, prevent the formation of the collector film; that the depressants act as solvents for an activating film naturally associated with the mineral; that the depressants act as solvents for the collecting film; and the like. These theories appear closely related and the correct theory may ultimately prove to involve elements from several, if not all, of them.

Currently, non-sulfide flotation systems have utilized depressants derived from natural substances such as starches, dextrins, gums and the like. See U.S. Pat. No. 3,292,780 to Frommer et al. and U.S. Pat. No. 3,371,778 to Iwasaki. However, from an ecological vantage point, the presence of residual depressants such as these in the waste waters increase the biodegradeable oxygen demand and the chemical oxygen demand, thereby creating a pollution problem in the disposal of these waste waters. From a commercial vantage point, there are an ever-increasing number of countries in which use of reagents having a food value, such as starch, is prohibited in commercial applications. Furthermore, the starch-type depressants require a complex preparation of the reagent solution involving a cooking stage prior to solution and the resultant reagent is susceptible to bacterial decomposition thereby requiring storage monitoring.

Accordingly, there exists the need for a synthetic depressant which can at once overcome the drawbacks of the conventional depressants currently utilized and yet perform in an equivalent or superior manner.

SUMMARY OF THE INVENTION

The present invention provides a process for depressing non-sulfide minerals in a flotation system. The process comprises adding to the flotation system an effective amount of a synthetic depressant wherein said synthetic depressant is a low molecular weight, partially hydrolyzed polymer or copolymer or water-soluble salts thereof of the general structure:

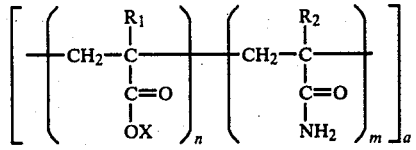

wherein $R_1$ and $R_2$ are individually hydrogen or a methyl radical, X is a hydrogen, alkali metal or ammonium ion, n and m are whole numbers such that the degree of hydrolysis is within the range from about 5 to 65% and n, m and a have a numerical value such that the total molecular weight of the polymer or copolymer is within the range from about 200 to 85,000. The process of the instant invention depresses non-sulfide minerals as well as comparable processes employing depressants derived from natural substances, such as starch, at approximately one-fourth the dosage. The instant process, besides overcoming the deficiencies attributable to employing non-synthetic depressants as set forth earlier, does not result in flocculation of the depressed mineral values.

DETAILED DESCRIPTION OF THE INVENTION

In accordance with the instant invention there is provided a process for depressing non-sulfide minerals in a flotation system. The process comprises adding to the flotation system a synthetic depressant during the flotation stage. The synthetic depressant employed in this process is a low molecular weight, partially hydrolyzed polymer or copolymer of general structure I. The molecular weight of the synthetic depressant should be within the range from about 200 to 85,000 and preferably within the range from about 1,000 to 10,000 as is exemplified in table 1. The degree of hydrolysis of the synthetic depressant should be from about 5% to 65%, preferably from about 20% to 55%, and more preferably, from about 40–45%. The hydrolyzed polyacrylamide can be prepared by first polymerizing acrylamide and then hydrolyzing some of the amide groups, or concurrent polymerization and hydrolysis or it may be made by other means, including copolymerization of acrylic acid and acrylamide, or hydrolysis of polyacrylonitrile, etc. In any event, there are the proper proportions of amide groups and the remainder being carboxyl groups, usually in the form of an alkali metal salt. The term hydrolyzed polyacrylamide is used as convenient understandable terminology rather than to limit the process of manufacture. Reagents which have been found particularly useful for hydrolysis include NaOH, KOH and $NH_4OH$.

The resulting low-molecular weight, partially hydrolyzed polymer or copolymer when employed as a depressant in the flotation system has exhibited improved selectivity and recovery over conventional depressants at substantially lower dosages of depressant. The synthetic depressant is easily diluted with water to provide a reagent solution that, due to its non-susceptibility to bacterial decomposition, can be stored almost indefinitely. The synthetic depressants should be added in an effective amount to obtain the desired degree of depression. Although this amount will vary depending upon the ore being processed, the flotation collector being employed, and other variables, it is generally on the order of about 0.2 to 0.75 pound of depressant per long ton of ore. This value is from one-sixth to one-third that dosage normally required to obtain equivalent recovery with starch depressants as is exemplified in table 2. Additionally, the instant process is capable of employing a combination of the synthetic depressants with a conventional, naturally derived depressant, such as starch and modified starch derivatives to arrive at substantially equivalent or improved performance to that obtained when employing the conventional depressant alone.

The process of the instant invention is believed to be compatible with all non-sulfide ore flotation systems. These include, but are not limited to, the separation of siliceous gangue from oxidic iron minerals; of copper from molybdenite; of galena from chalcopyrite and sphalerite; of apatite from ilmenite; of fluorspar from calcite; of sylvite from halite and clay, and the like.

The following specific examples illustrate certain aspects of the present invention and, more particularly, point out methods of evaluating the process for depressing non-sulfide minerals in a flotation system. However, the examples are set forth for illustration only and are not to be construed as limitations on the present invention except as set forth in the appended claims. All parts and percentages are by weight unless otherwise specified.

EXPERIMENTAL PROCEDURE

Step 1: Grinding

600 Parts of crude iron ore having a particle size of minus 10 mesh are mixed with 400 ml. of deionized water, 5.0 ml. of a 2% sodium silicate "N" solution and 1.8 ml. of a 25% NaOH solution.

The resulting mixture is subjected to grinding in a rod mill for 50 minutes and thereafter is transferred into a 8 liter cylinder. To this cylinder there are added 200 ml. of 0.05% $Ca(OH)_2$ solution and an amount of deionized water sufficient to fill the cylinder to the 8 liter mark.

Step 2: Desliming

The cylinder mixture is subjected to mechanical stirring for 1 minute during which time there is added 6.9 parts of a 1% corn starch solution as the desliming aid. The stirring is then stopped and the mixture is allowed to settle for 12 minutes, after which approximately 7 liters of the supernatant layer is syphoned off and filtered, resulting in the slime product.

Step 3: Rougher Float

The remaining 1 liter underflow is transferred to a flotation bowl and water containing 17 ppm of calcium as $CaCO_3$ is added to the bowl until the level reaches the lip. The pulp is briefly agitated at 1200 rpm and thereafter the pH is adjusted to approximately 10.6 through the addition of 5–10 drops of 10% NaOH. 27.3 Parts of a 1% starch solution is then added as a depressant and a two-minute conditioning time is allowed.

4.9 Parts of a 1% solution of a commercially available collector is added, 30 seconds of conditioning is allowed followed by a four-minute float. After the float, 3.3 parts of a 1% solution of a commercially available collector is again added, 30 seconds of conditioning is allowed and then followed by a second four-minute float.

The froth collected from the first and second floats is labeled the rougher float and the remainder in the flotation bowl is labeled the rougher concentrate.

Step 4: Scavenger Float

The rougher float is transferred to a second flotation bowl to which there is added 13.6 parts of a 1% corn starch solution as a depressant. Two minutes of conditioning is allowed before air is introduced into this bowl for 3–4 minutes. The froth collected is labeled the final froth.

Step 5: Middling Float

The underflow from the scavenger float is further conditioned for 30 seconds with 1.4 parts of a 1% solution of a commercially available collector and thereafter floated for 3 minutes. The middling float sequence is repeated a second time and the combined froth from these two floats is labeled the middling froth. The underflow remaining is combined with the rougher concentrate and labeled the concentrate.

COMPARATIVE EXAMPLE A & B

The Experimental Procedure set forth above is followed in every material detail employing as the depressant 1.5 pounds of starch per long ton of iron ore in the flotation steps. Test results are set forth in Table I.

COMPARATIVE EXAMPLE C

The Experimental Procedure set forth above is followed in every material detail employing as the depressant 0.75 pound of starch per long ton of iron ore in the flotation steps. Test results are set forth in Table I.

EXAMPLE 1

The Experimental Procedure set forth above is followed in every material detail employing as the depressant 0.375 pound of a 45% hydrolyzed polyacrylamide having a molecular weight of 6200 per long ton of iron ore in place of the starch used during the flotation steps. Test results are set forth in Table I.

EXAMPLE 2

The Experimental Procedure set forth above is followed in every material detail employing as the depressant 0.375 pound of 29% hydrolyzed polyacrylamide having a molecular weight of 6200 per long ton of iron ore in place of the starch used during the flotation steps. Test results are set forth in Table I.

TABLE I

Desliming-Flotation Performance of Oxidized Iron Ore

| | | | Weight % | | | | Calcu- | % Fe Assay | | | |
|---|---|---|---|---|---|---|---|---|---|---|---|
| Example | Depressant | Dose lb/LT | Slime | Concen-trate | Final Froth | Middl. Froth | lated Head | Slime | Conc. | Final Froth | Middl. Froth |
| Comp. A | Corn Starch | 1.5 | 19.11 | 42.17 | 34.60 | 4.10 | 36.21 | 8.9 | 67.5 | 12.7 | 40.6 |
| Comp. B | Corn Starch | 1.5 | 19.7 | 40.9 | 35.3 | 4.1 | 36.54 | 10.9 | 67.4 | 13.7 | 48.2 |
| Comp. C | Corn Starch | 0.75 | 18.37 | 39.22 | 37.54 | 4.85 | 36.68 | 9.1 | 67.7 | 16.2 | 49.2 |
| 1 | Synthetic A | 0.375 | 20.15 | 39.05 | 35.24 | 5.54 | 35.55 | 9.7 | 66.1 | 15.6 | 41.5 |

TABLE I-continued

Desliming-Flotation Performance of Oxidized Iron Ore

| | | | | | | | | | | | |
|---|---|---|---|---|---|---|---|---|---|---|---|
| 2 | Synthetic B | 0.375 | 20.0 | 39.3 | 35.5 | 4.4 | 36.60 | 10.1 | 67.8 | 16.3 | 49.8 |

| | | | | Fe Distribution | | | |
|---|---|---|---|---|---|---|---|
| Example | Depressant | Dose lb/LT | Insol Conc. | Slime | Conc. | Final Froth | Middle. Froth |
| Comp. A | Corn Starch | 1.5 | 4.14 | 4.69 | 78.60 | 12.12 | 4.58 |
| Comp. B | Corn Starch | 1.5 | 3.50 | 5.9 | 75.5 | 13.2 | 5.4 |
| Comp. C | Corn Starch | 0.75 | 3.83 | 4.55 | 72.38 | 16.57 | 6.49 |
| 1 | Synthetic A | 0.375 | 4.19 | 5.48 | 72.60 | 15.44 | 6.74 |
| 2 | Synthetic B | 0.375 | 2.61 | 5.7 | 72.6 | 15.8 | 6.0 |

Synthetic A = 45% Hydrolyzed Polyacrylamide (MW 6200).
Synthetic B = 29% Hydrolyzed Polyacrylamide (MW 6200).

EXAMPLES 3-6

The Experimental Procedure set forth above is followed in every material detail except that in place of the starch used as a depressant in the flotation steps there is now employed a synthetic depressant. In each instance, the synthetic depressant employed is a 42–45% hydrolyzed polyacrylamide. The molecular weight is varied in each example so as to demonstrate its effect on recovery and selectivity. Test results are set forth in Table II below.

TABLE II

Performance of Synthetic Depressants As a Function of Their Molecular Weight

| | Depressant | | | | | | |
|---|---|---|---|---|---|---|---|
| Example | Mol. Wt. | % Hydrolysis | Dosage lb/LT | Collector Dosage lb/LT | % Recovery | % Insolubles | Grade |
| 3 | 1,000 | 45 | 0.375 | 0.24 | 75.45 | 7.11 | 64.0 |
| 4 | 7,000 | 43 | 0.50 | 0.30 | 76.51 | 4.89 | 67.1 |
| 5 | 29,700 | 45 | 0.375 | 0.40 | 70.6 | 3.21 | 67.5 |
| 6 | 85,000 | 45 | 0.375 | 0.40 | 66.9 | 4.16 | 66.7 |

EXAMPLES 7-10

The Experimental Procedure set forth above is followed in every material detail except that in place of the starch used as a depressant in the flotation steps there is now employed a synthetic depressant. The synthetic depressant is a partially hydrolyzed polyacrylamide having a molecular weight of 6000–7000, various degrees of hydrolysis were employed to show their effect on recovery, grade and insolubles; and a control example is utilized to show the effects of non-hydrolysis. Test results are set forth in Table III.

TABLE III

Performance of Synthetic Depressants As a Function of the Degree of Hydrolysis

| | Depressant | | | | | | |
|---|---|---|---|---|---|---|---|
| Example | Mol. Wt. | % Hydrolysis | Dosage lb/LT | Collector Dosage lb/LT | % Recovery | % Insolubles | Grade |
| Control | 6000 | 0 | 0.50 | 0.4 | 64.23 | 2.89 | 68.2 |
| 7 | 6000 | 29 | 0.375 | 0.3 | 68.06 | 3.95 | 66.8 |
| 8 | 7000 | 43 | 0.50 | 0.3 | 76.51 | 4.89 | 67.1 |
| 9 | 7000 | 66 | 0.375 | 0.3 | 63.67 | 4.26 | 66.4 |
| 10 | 7000 | 98 | 0.50 | 0.4 | 57.14 | 2.62 | 68.1 |

EXAMPLES 11-15

The Experimental Procedure set forth above is followed in every material detail except that in place of the starch used as a depressant in the flotation steps there is now employed a 43% hydrolyzed polyacrylamide having a molecular weight of 7000. The dosage is varied to show its effect on recovery, grade and insolubles. Test results are set forth in Table IV and plotted on the graph depicted in FIG. 2.

COMPARATIVE EXAMPLES D & E

The Experimental Procedure set forth above is followed in every material detail employing 0.75 and 1.5 pounds per corn starch per long ton of iron ore, respectively, in the flotation steps. Test results are set forth in Table IV.

TABLE IV

Performance of Synthetic Depressants As a Function of the Dosage Employed

| Example | Depressant | Depressant Dosage lb/LT | Collector Dosage lb/LT | % Recovery | % Insolubles | Grade |
|---|---|---|---|---|---|---|
| Control | None | None | 0.4 | 63.27 | 4.22 | 67.0 |
| 11 | | 0.127 | 0.26 | 73.62 | 4.68 | 67.8 |
| 12 | | 0.254 | 0.26 | 76.78 | 5.2 | 65.7 |
| 13 | 43% Hydrolyzed Polyacrylamide with 7000 Mol. | 0.375 | 0.4 | 72.60 | 4.19 | 66.1 |

TABLE IV-continued

| Example | Depressant | Performance of Synthetic Depressants As a Function of the Dosage Employed: Depressant Dosage lb/LT | Collector Dosage lb/LT | % Recovery | % Insoluables | Grade |
|---|---|---|---|---|---|---|
| 14 | Weight | 0.50 | 0.3 | 76.51 | 4.89 | 67.1 |
| 15 | | 0.75 | 0.3 | 77.51 | 4.8 | 65.3 |
| Comp. D | Corn Starch | 0.75 | 0.4 | 70.86 | 4.36 | 66.5 |
| Comp. E | Corn Starch | 1.5 | 0.4 | 75.40 | 4.78 | 66.9 |

EXAMPLES 16–17

The Experimental Procedure set forth above is followed in every material detail except that in place of the starch used as a depressant in the flotation steps there is now employed a mixture of starch and 43% hydrolyzed polyacrylamide having a molecular weight of 6200, to show their effect on recovery, grade and unsolubles. Two control examples are utilized to show the comparative effect of the mixture. Test results are set forth in Table V.

TABLE V

| Examples | Depressant Mixture | Performance of Mixtures of Starch/Synthetic Depressants: Mixture Dosage lb/LT | Collector Dosage lb/LT | % Recovery | % Insoluables | % Grade |
|---|---|---|---|---|---|---|
| Control A | Corn Starch/ No Synthetic Depressant | 1.5/0 | 0.4 | 78.4 | 4.21 | 66.5 |
| Control B | Ethoxylated Corn Starch/No Synthetic Depressant | 1.5/0 | 0.4 | 70.58 | 3.51 | 67.8 |
| 16 | Corn Starch/43% Hydrolyzed PAM | 0.75/0.375 | 0.4 | 77.77 | 3.82 | 67.5 |
| 17 | Ethoxylated Corn Starch/43% Hydrolyzed PAM | 0.75/0.375 | 0.4 | 79.24 | 3.56 | 67.3 |

EXAMPLE 18

When the Experimental Procedure set forth above is employed in the flotation process wherein copper is separated from molybdenite, depression performance substantially equivalent to that achieved in an iron ore flotation system is obtained employing a 45% hydrolyzed polyacrylamide having a molecular weight of 7000 as the depressant.

EXAMPLE 19

When the Experimental Procedure set forth above is employed in the flotation process wherein galena is separated from chalcopyrite and sphalerite, depression performance substantially equivalent to that achieved in an iron ore flotation system is obtained employing a 45% hydrolyzed polyacrylamide having a molecular weight of 500 as the depressant.

EXAMPLE 20

When the Experimental Procedure set forth above is employed in the flotation process wherein apatite is separated from ilmenite, depression performance substantially equivalent to that achieved in an iron ore flotation system is obtained employing a 45% hydrolyzed polyacrylamide having a molecular weight of 7000 as the depressant.

EXAMPLE 21

When the Experimental Procedure set forth above is employed in the flotation process wherein fluorspar is separated from calcite, depression performance substantially equivalent to that achieved in an iron ore flotation system is obtained employing a 45% hydrolyzed polyacrylamide having a molecular weight of 7000 as the depressant.

EXAMPLE 22

When the Experimental Procedure set forth above is employed in the flotation process wherein sylvite is separated from halite and clay, depression performance substantially equivalent to that achieved in an iron ore flotation system is obtained employing a 10% hydrolyzed polyacrylamide having a molecular weight of 7000 as the depressant.

We claim:

1. A process for depressing oxidic iron minerals in a flotation system which comprises adding to the flotation system, as a selective depressant, an effective amount of a copolymer or water soluble salt thereof of the general structure:

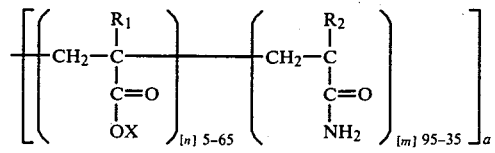

wherein $R_1$ and $R_2$ are individually hydrogen or a methyl radical, X is a hydrogen, alkali metal or ammonium ion and a has a numerical value such that the total molecular weight of the copolymer is within the range from about 200 to 85,000.

2. The process of claim 1 wherein the molecular weight is within the range from about 1,000 to 10,000.

3. The process of claim 1 wherein the degree of hydrolysis is within the range from about 20% to 55%.

4. The process of claim 3 wherein the degree of hydrolysis is within the range from about 40–45%.

5. The process of claim 1 wherein said synthetic depressant is a 45% hydrolyzed polyacrylamide having a molecular weight on the order of 7000.

6. The process of claim 1 wherein the effective amount of the synthetic depressant is about 0.125 to 0.75 pound per long ton of oxidic iron ore.

7. A process for depressing oxidic iron minerals in a flotation system which comprises adding to the flotation system, as a selective depressant, an effective amount of a mixture of a naturally derived depressant and a copolymer or water soluble salt thereof of the general structure:

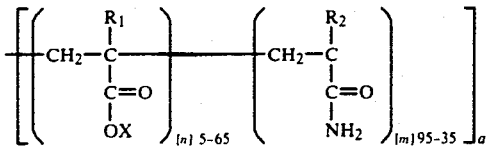

wherein $R_1$ and $R_2$ are individually hydrogen or a methyl radical, X is a hydrogen, alkali metal or ammonium ion and a has a numerical value such that the total molecular weight of the copolymer is within the range from about 200 to 85,000.

8. The process of claim 7 wherein said naturally derived depressant is starch.

9. The process of claim 7 wherein the molecular weight is within the range from about 1,000 to 10,000.

10. The process of claim 7 wherein the degree of hydrolysis is within the range from about 20% to 55%.

11. The process of claim 7 wherein the degree of hydrolysis is within the range from about 40–45%.

12. The process of claim 7 wherein said copolymer is a 45% hydrolyzed polyacrylamide having a molecular weight on the order of 7000.

13. The process of claim 7 wherein the effective amount of the selective depressant is about 0.125 to 0.75 pound per long ton of oxide iron.

* * * * *